United States Patent [19]

Ketelhut et al.

[11] Patent Number: 4,653,143

[45] Date of Patent: Mar. 31, 1987

[54] VEHICLE DOOR HANDLE ASSEMBLY

[75] Inventors: Robert W. Ketelhut, Lake Orion; Mark A. Kwiatkowski, Ortonville, both of Mich.

[73] Assignee: General Motors Corporation, Detroit, Mich.

[21] Appl. No.: 835,189

[22] Filed: Mar. 3, 1986

[51] Int. Cl.[4] ..... F05B 7/00

[52] U.S. Cl. ..... 16/124; 292/336.3

[58] Field of Search ..... 292/347, 336.3, 216, 292/DIG. 38; 16/112, 114 R, 115, 124, 126, DIG. 24, 127; 296/37.13

[56] References Cited

U.S. PATENT DOCUMENTS

| | | | |
|---|---|---|---|
| 3,858,921 | 1/1975 | Kuki | 292/336.3 |
| 3,967,844 | 7/1976 | Forii et | 292/336.3 |
| 4,041,301 | 8/1977 | Pelchat . | |
| 4,054,307 | 10/1977 | Carella et al. | 292/336.3 |
| 4,475,415 | 10/1984 | Yamamoto | 292/336.3 |

*Primary Examiner*—Nicholas P. Godici
*Assistant Examiner*—Karen Skillman
*Attorney, Agent, or Firm*—Herbert Furman

[57] ABSTRACT

A door handle assembly includes an escutcheon having a rib formation defining the opening of the handle assembly and including a wall portion which is offset inwardly of the rib formation. A support member and lift handle module and a gasket assembly complete the door handle assembly. The support member provides the upper wall portion of the door handle assembly and additionally mounts the lift handle which is located within the upper portion of the door handle opening. The module is fixtured to the escutcheon to set the spacing between the lift handle and the rib formation prior to securement of the support member to the escutcheon. The gasket assembly seats between the rib formation of the escutcheon and the supporting door panel.

3 Claims, 6 Drawing Figures

VEHICLE DOOR HANDLE ASSEMBLY

This invention relates generally to vehicle door handle assemblies and more particularly to vehicle door handle assemblies of the lift handle type.

Vehicle door handle assemblies of the lift handle type are well known and are in current production use on several makes of automobiles sold in the United States. The handle assembly of this invention is of this general type but includes certain features which improve the manufacturing and operating efficiency of the handle and also improve its aesthetic appearance.

The handle assembly of this invention includes a generally rectangularly shaped escutcheon, a lift handle and support member module, and a gasket assembly. The handle assembly includes a peripheral rib formation provided by the escutcheon and an inwardly offset wall within the rib formation, the upper portion of which is provided by a wall portion of the support member of the module, and the lower portion of which is provided by a wall portion of the escutcheon. The wall portions of the support member and the escutcheon mate generally along the longitudinal center line of the handle assembly. The lift handle of the module covers the upper portion of the inwardly offset wall and also covers the juncture of the wall portions of such wall from exterior view. Access to the inner side of the lift handle by the operator's fingers is provided through the lower portion of the inwardly offset wall. The lift handle includes legs which extend inwardly through openings in the upper portion of the inwardly offset wall of the handle assembly for pivotal connection to the support member inwardly of such wall. The lift handle is preassembled to the support member and the support member is then fixtured relative to the escutcheon to locate the outer edge of the lift handle a predetermined uniform distance from the peripheral rib formation for aesthetic appearance. The wall portions of the support member and escutcheon are secured to each other adjacent their juncture after fixturing. The gasket assembly includes a gasket member which seats against the inner side of the rib formation of the escutcheon and a pair of extensions which close the space between the rib formation of the escutcheon and the legs of the lift handle. Each extension includes a retainer portion which extends over the edge of the wall portion of the escutcheon underneath a respective leg of the lift handle and is engaged by the lift handle to locate the lift handle in a non-operating position and ensure noiseless contact between the lift handle and the escutcheon. Flanges of the support member overlie the retainer portions and are bolted to the inner side of the wall portion of the escutcheon to clamp the retainer portions to the wall portion of the escutcheon as well as provide for additional securement of the module to the escutcheon. The bolts which secure the flanges to the wall portion of the escutcheon also provide for mounting of the handle assembly to the edge portion of a vehicle door or other panel opening receiving the inwardly offset wall of the handle assembly and the legs of the lift handle.

The primary feature of this invention is that it provides a vehicle door handle assembly which includes an escutcheon and a lift handle and support member module which is adjustable relative to the escutcheon to fix the clearance relationship between the lift handle and the escutcheon prior to securement of the module to the escutcheon. This provides for a uniform gap or clearance between the edge of the lift handle and peripheral rib formation of the escutcheon for improved appearance of the door handle assembly. Another feature is that an inwardly offset wall of the door handle assembly is cooperatively provided by wall portions of the escutcheon and of the support member for manufacturing efficiency. A further feature is that the wall portions mate generally along the longitudinal center line of the handle assembly and that the juncture of the wall portions is covered from exterior view by the lift handle. Yet another feature is that the lift handle includes legs which extend through the inwardly offset wall of the door handle assembly and are pivotally mounted to the support member inwardly of such inwardly offset wall. Yet a further feature is that the door handle assembly includes a gasket assembly having a gasket member which seals the escutcheon to the edge portion of an opening in a vehicle body panel and which additionally includes retainer portions locating the lift handle in a non-operating position and ensuring noiseless contact of the lift handle and the escutcheon. Still another feature is that the gasket assembly includes extensions closing the space between the legs of the lift handle and the peripheral rib formation of the escutcheon.

These and other features will be readily apparent from the following specification and drawings wherein.

Figure 1:
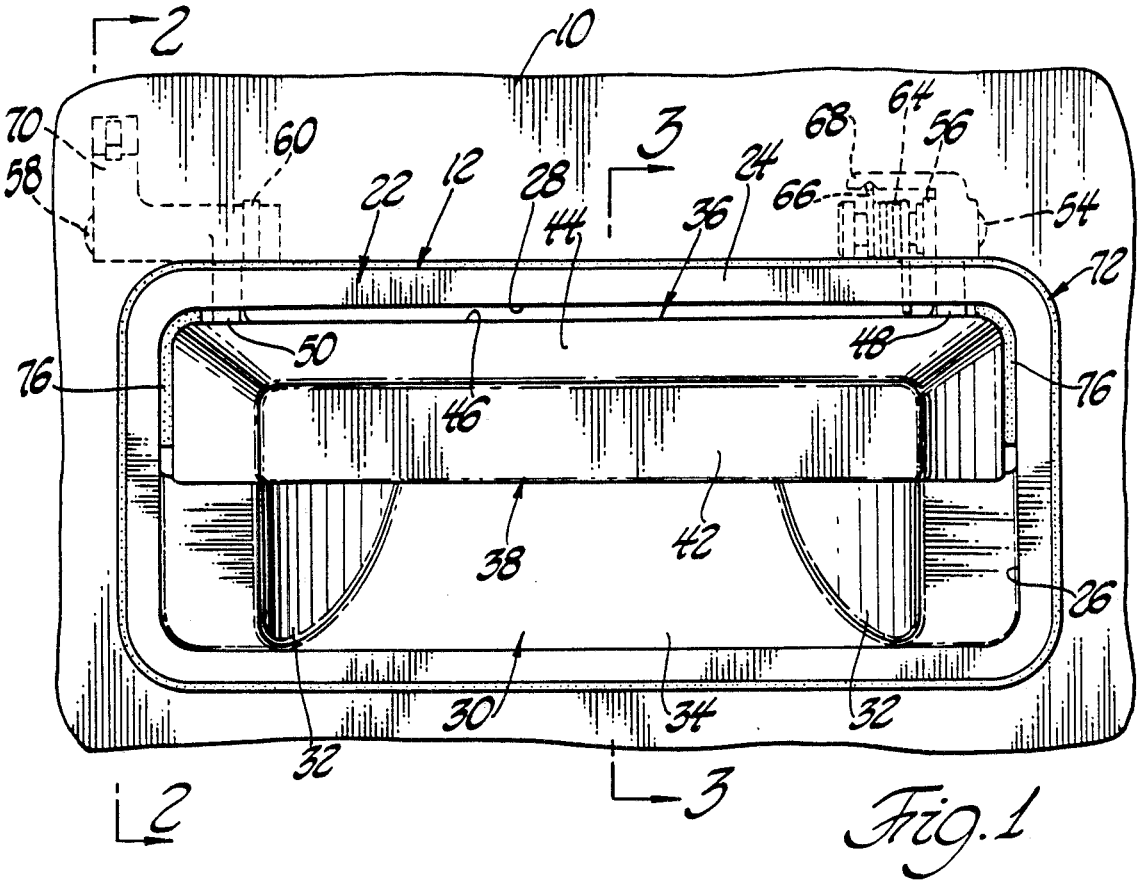
FIG. 1 is a front elevational view of a door handle assembly according to this invention mounted on a vehicle body door outer panel.

Referring now to FIG. 1 of the drawings, a vehicle body door outer panel designated generally 10 mounts a door handle assembly designated generally 12 according to this invention. The panel 10 includes a recessed cutout 14, FIGS. 3, 4, 5, having an elongated upper portion 16, FIG. 4, and an elongated lower portion 18 of less length to provide mounting portions 20, as will be further described.

The handle assembly 12 includes an escutcheon 22 which is generally of rectangular shape and has a peripheral outer rib formation 24 defining the opening 26 of the handle assembly. The escutcheon 22 includes an upper elongated opening 28 and a lower inset wall portion 30 having a pair of planar inset integral side walls 32 which are integrally joined by a recessed wall 34.

The lift handle and support member module 36 includes a lift handle 38 and a support member 40. The handle 38 is formed of die cast material and includes an outer planar wall portion 42 located outside the plane of rib formation 24 and a multi-angular peripheral portion 44, the outer edge 46 of which is spaced a predetermined gap or distance from the juxtaposed inner edge of the opening 28. A pair of legs 48 and 50, FIG. 4, extend inwardly of the lift handle 38 along each side edge 52 of the support member 40. The leg 48 is pivoted at 54 to an upstanding ear 56 of the support member 40 and the leg 50 is coaxially pivoted at 58 to an upstanding ear 60 of the support member 40. The ears 56 and 60 are lanced from the upper wall 62 of the support member. The pivot 54 includes a shouldered extension, FIG. 4, which mounts a coil torsion spring 64. One leg 66 of the spring engages a notched lateral extension 68 of leg 48 and the other leg of the spring seats against an edge of the upper wall 62 of the support member 40 to bias the handle 38 clockwise as viewed in FIGS. 2, 3, 5 and 6 or inwardly of the escutcheon 22. The leg 50 of handle 38 includes a slotted extension 70 which is connectable to a dash line indicated operating rod of a vehicle door latch assembly, not shown. The rod is shifted downwardly when the handle 38 is moved outwardly of the escutcheon to an operative position, indicated in dash lines in FIG. 2, to release the door latch assembly.

Figure 2:
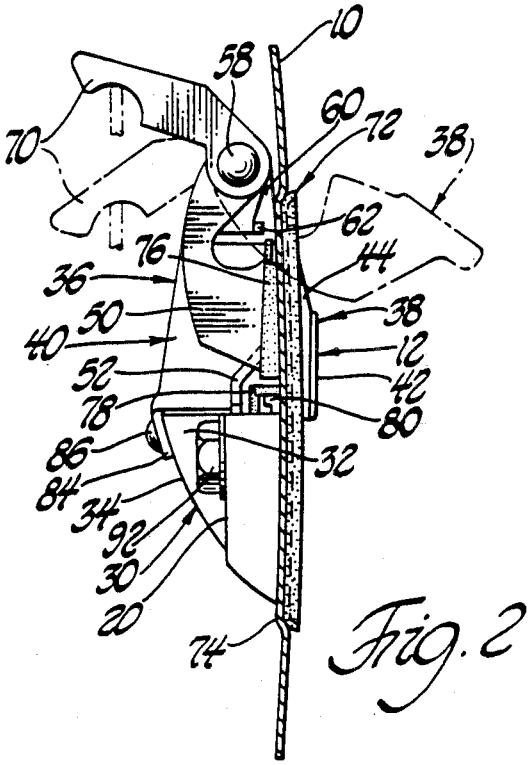
FIG. 2 is a view taken along line 2—2 of FIG. 1.
Figure 3:
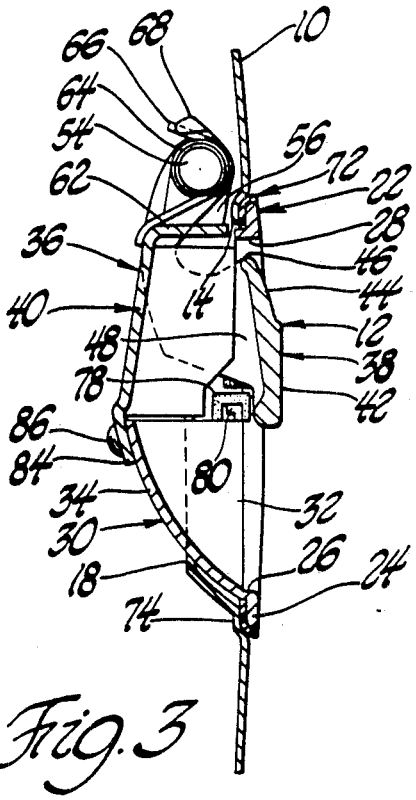
FIG. 3 is a sectional view taken along line 3—3 of FIG. 1.

A gasket assembly 72 of rectangular shape fits between the rib formation 24 of the escutcheon and the inwardly offset flange 74 of panel 10, the edge of which defines the majority of cutout 14. The gasket assembly partially wraps around the outer edge of the rib formation as best shown in FIGS. 2, 3 and 5. The gasket assembly further includes a pair of integral inwardly extending flaps 76, FIGS. 1 and 4, which cover the space between the opening 28 of the escutcheon 22 and each of the legs 48 and 50. The gasket assembly also includes a pair of U-shaped portions 78, FIG. 5, which fit over the upper edges 80 of the walls 32 of the escutcheon and are integrally connected to the gasket assembly by triangular portions 82. Portions 78 act as bumpers for handle 38, FIGS. 3 and 5.

The handle 38, the support member 40, and the spring 64 are preassembled to each other to provide the module 36. Thereafter the module 36 and the escutcheon are assembled to each other by fitting the openings of an apertured flange 84 of the support member 40 over integral studs 86 on the inner side of the wall 34 of the escutcheon. The apertures of the flange 84 are larger than the studs 86. The clearance or gap between the edge of opening 26 and the outer edge 46 of the handle 38 is then fixtured or controlled so as to be uniform and the studs 86 are then spun over the flange 84 to assemble the module to the escutcheon. The lower edge of the support member 40 is located adjacent to and follows the contour of wall 34 of wall portion 30 of escutcheon 22. The support member and wall 34 thus cooperatively provide the upper and lower wall portions of the inwardly offset wall of the handle assembly. The handle 38 covers the juncture of these wall portions, FIGS. 1, 2, 3 and 5. The wall 34 provides access to the inner side of handle 38 for the operator's fingers.

Figure 4:
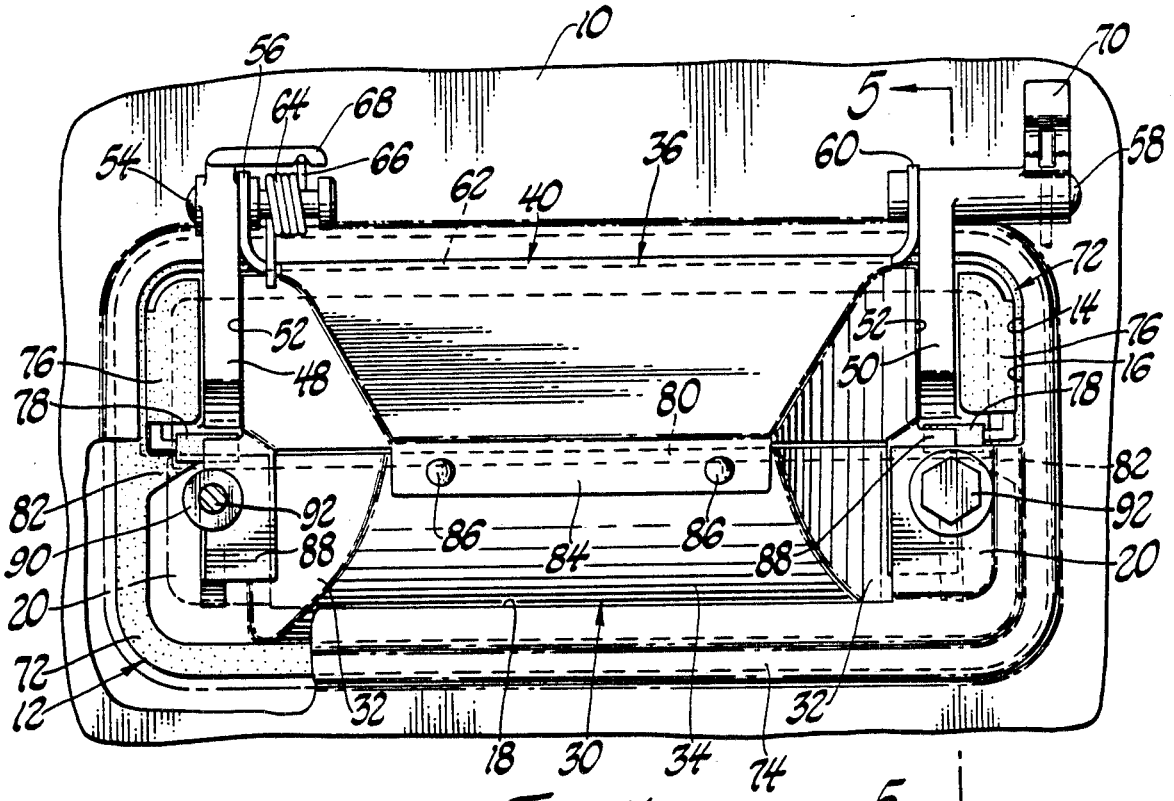
FIG. 4 is a rear elevational view with portions thereof broken away.
Figure 5:
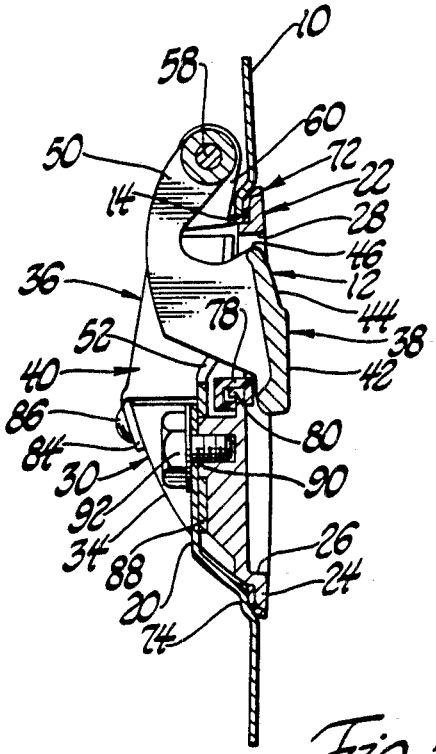
FIG. 5 is a sectional view taken along line 5—5 of FIG. 4.
Figure 6:
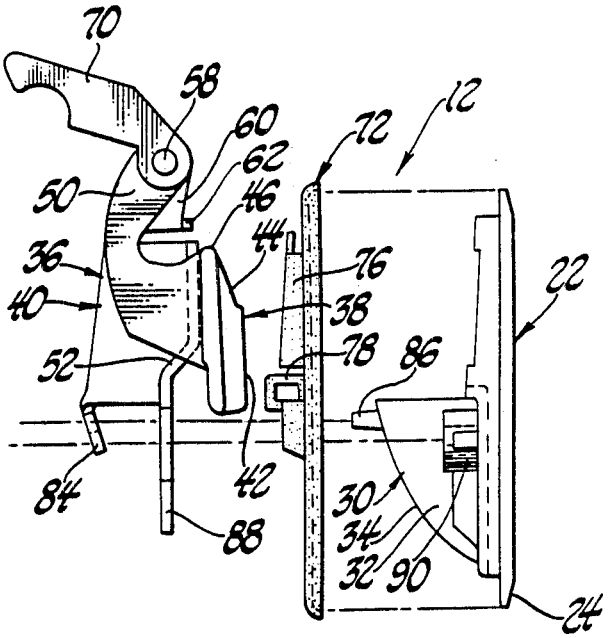
FIG. 6 is a partial blown apart view.

The support member 40 includes a pair of integral depending planar apertured tabs 88, FIGS. 4, 5, and 6 which seat on integral apertured ribbed bosses 90 on the inner side of the side walls 32 of the escutcheon 22. Tabs 88 overlie the U-shaped portions 78 of the gasket assembly 72 as shown in FIGS. 4 and 5.

When the handle assembly is mounted on the panel 10, the upper portion 16 of cutout 14 receives the module 36 and the lower portion 18 of the cutout 14 receives the wall 34 of wall portion 30. The gasket assembly 72 seats against the flange 74 of panel 10 and the tabs 88 seat against the mounting portions 20 of the panel 10. Bolts 92 extend through apertures in the mounting portions 20 and the tabs 88 to secure the handle assembly 12 to the panel 10. After such securement, the operating rod secured to the extension 70 of the lift handle 38 is secured to the vehicle door latch to complete the operational assembly of the handle assembly to the vehicle.

Thus this invention provides an improved vehicle door handle assembly.

The embodiments of the invention in which an exclusive property or privilege is claimed are defined as follows:

1. A vehicle door handle assembly comprising, in combination, a generally rectangularly shaped escutcheon having a rib formation defining an inner opening for a door handle and the outer periphery of the handle assembly, the escutcheon including a wall portion inwardly offset from the rib formation and closing the lower portion of the opening of the escutcheon, a support member located inwardly of the upper portion of the escutcheon and including a wall portion within the upper portion of the opening of the escutcheon, the support member wall portion having an edge portion mating with an edge portion of the wall portion of the escutcheon generally along the longitudinal center line of the handle assembly, a lift handle overlying the wall portion of the support member and located within the upper portion of the opening of the escutcheon in the non-operating position, the lift handle including a pair of legs extending inwardly of the support member and pivoted thereto to the inner side of the handle assembly for movement of the lift handle outwardly of the opening of the escutcheon to an operating position, resilient means connected between the support member and the lift handle and biasing the lift handle to a non-operating position within the upper portion of the opening of the escutcheon, the lift handle being pivoted to the support member to form a module prior to the support member and the lift handle being assembled to the escutcheon, the wall portion of the support member including a flange overlying the wall portion of the escutcheon along their mating edge portions, means securing the support member flange to the escutcheon wall portion after the lift handle has been located within the upper portion of the opening of the escutcheon and spaced a predetermined distance from the rib formation, additional means for securing the support member and escutcheon to a door panel, a gasket assembly seating against the inner side of the escutcheon, and means securing the gasket assembly to the inner side of the wall portion of the escutcheon.

2. A vehicle door handle assembly comprising, in combination, a generally rectangularly shaped escutcheon having a rib formation defining an inner opening for a door handle and the outer periphery of the handle assembly, the escutcheon including a wall portion inwardly offset from the rib formation and closing the lower portion of the opening of the escutcheon, a support member located inwardly of the upper portion of the escutcheon and including a wall portion of lesser longitudinal extent than the escutcheon wall portion and partially closing the upper portion of the opening of the escutcheon and mating with the wall portion of the escutcheon generally along the longitudinal center line of the handle assembly, a lift handle overlying the wall portion of the support member and located within the upper portion of the opening of the escutcheon in the non-operating position, the lift handle including a pair of legs extending inwardly of the support member to either side of the wall portion thereof and pivoted thereto to the inner side of the handle assembly for movement of the lift handle outwardly of the opening of the escutcheon to an operating position, resilient means connected between the support member and the lift handle and biasing the lift handle to a non-operating position within the upper portion of the opening of the escutcheon, the lift handle being pivoted to the support member to form a module prior to the support member and the lift handle being assembled to the escutcheon, the wall portion of the support member including a flange having apertures loosely receiving locators on the wall portion of the escutcheon to permit adjustment of the lift handle within the upper portion of the opening of the escutcheon and the obtainment of uniform spacing of the lift handle and the rib formation, the flange being secured to the wall portion of the escutcheon after the spacing of the lift handle and rib formation is set, a gasket assembly seating against the inner side of the escutcheon and including extensions overlying the wall portion of the escutcheon and providing resilient stops engageable by the lift handle in non-operating position, and means securing the gasket assembly to the inner side of the wall portion of the escutcheon.

3. A vehicle door handle assembly comprising, in combination, a generally rectangularly shaped escutcheon having a rib formation defining an inner opening for a door handle and the outer periphery of the handle assembly, the escutcheon including a wall portion inwardly offset from the rib formation and closing the lower portion of the opening of the escutcheon, a support member located inwardly of the upper portion of the escutcheon and including a wall portion partially closing the upper portion of the opening of the escutcheon, the support member wall portion having an edge portion mating with an edge portion of the wall portion of the escutcheon generally along the longitudinal center line of the handle assembly, a lift handle overlying the wall portion of the support member and located within the upper portion of the opening of the escutcheon in the non-operating position, the lift handle covering the mating edge portions of the wall portions from view from the outer side of the handle assembly, the lift handle including a pair of legs extending inwardly of the support member and pivoted thereto to the inner side of the handle assembly for movement of the lift handle outwardly of the opening of the escutcheon to an operating position, resilient means connected between the support member and the lift handle and biasing the lift handle to a non-operating position within the upper portion of the opening of the escutcheon, the lift handle being pivoted to the support member to form a module prior to the support member and the lift handle being assembled to the escutcheon, the wall portion of the support member including an apertured flange loosely receiving locators on the wall portion of the escutcheon to permit adjustment of the spacing of the lift handle relative to the rib formation, the locators being headed over the flange of the support member wall portion after the spacing of the lift handle and rib formation is set, a gasket assembly seating against the inner side of the escutcheon flange means on the wall portion of the support means overlying the wall portion of the escutcheon, and means securing the flange means to the inner side of the wall portion of the escutcheon and additionally providing for securement of the handle assembly to a supporting vehicle door.

* * * * *